United States Patent [19]

Forrest

[11] Patent Number: 4,926,949

[45] Date of Patent: May 22, 1990

[54] THERMAL SHIELD FOR DRILLING MOTORS

[75] Inventor: John Forrest, Houston, Tex.

[73] Assignee: Drilex Systems, Inc., Houston, Tex.

[21] Appl. No.: 281,153

[22] Filed: Dec. 7, 1988

[51] Int. Cl.[5] ..... E21B 4/02

[52] U.S. Cl. ..... 175/17; 175/107; 175/324

[58] Field of Search ..... 175/107, 92, 100, 324, 175/17; 415/175, 176, 901, 903, 904

[56] References Cited

U.S. PATENT DOCUMENTS

| | | | |
|---|---|---|---|
| 3,291,230 | 12/1966 | Cullen et al. | 175/107 X |
| 3,598,187 | 8/1971 | Mothre | 175/107 X |
| 3,650,337 | 3/1972 | Andrews et al. | 175/17 |
| 3,667,556 | 6/1972 | Henderson | 175/107 X |
| 3,903,974 | 9/1975 | Cullen | 175/17 |
| 4,011,917 | 3/1977 | Tiraspolsky et al. | 175/107 |
| 4,143,722 | 3/1979 | Driver | 175/107 X |
| 4,265,323 | 5/1981 | Juergens | 175/107 |
| 4,534,427 | 8/1985 | Wang et al. | 175/107 X |
| 4,646,856 | 3/1987 | Dismukes | 175/107 |

FOREIGN PATENT DOCUMENTS

| | | | |
|---|---|---|---|
| 8704753 | 8/1987 | PCT Int'l Appl. | 175/107 |
| 857414 | 8/1981 | U.S.S.R. | 175/107 |

*Primary Examiner*—Hoang C. Dang

*Attorney, Agent, or Firm*—Edgar A. Zarins; Malcolm L. Sutherland

[57] ABSTRACT

A thermal jacket shield for a drilling motor which permits drilling operations in high temperature wells without failure of the motor. The thermal shield includes a multiple passageway casing to shroud the motor and through which is circulated drilling fluid used to operate the drilling motor. The motor is positioned within concentric inner and outer shells which form a fluid annulus through which the fluid is circulated. An intermediate housing sub connected to the lower end of the drilling motor includes a nozzle through which a controlled quantity of drilling fluid is passed into the annulus formed by the inner and outer annular shells. Outlet ports in the outer shell allow the drilling fluid to flow to the exterior of the tool. As a result, cooling fluid is continuously passed through the jacket shield to maintain the operating temperature of the motor at an acceptable temperature.

31 Claims, 2 Drawing Sheets

THERMAL SHIELD FOR DRILLING MOTORS

Background Of The Invention

I. Field of the Invention

This invention relates to a housing for drilling motors and, in particular, to a housing which circulates drilling fluid therethrough to form a thermal shield to maintain acceptable operating temperatures for the drilling motor.

II. Description of the Prior Art

Drilling motors are used in downhole operations to drive drill bits and the like for drilling well holes, descaling geothermal wells, etc. The drill motors operate to drive the downhole tool by circulating drilling fluid through the motor. One type of drilling motor is a positive displacement drilling motor which includes an elastomer stator bonded to the outer steel casing of the motor. Because of the material properties of the elastomer and bonding material, the operating temperature must be maintained below a certain level to prevent damage and malfunction of the motor. Typically, the bonding material and elastomer will begin to deteriorate at approximately 250 degrees Fahrenheit. Thus, in the past, such motors would malfunction in deep wells and geothermal wells where temperatures may exceed 500 degrees Fahrenheit.

Summary Of The Present Invention

The present invention overcomes the disadvantages of the prior art by providing an outer casing for the drilling motor to shroud the motor against the high temperature within the wellhole.

The drilling motor construction according to the present invention includes a thermal jacket within which the motor is mounted and through which drilling fluid is circulated to maintain proper operating temperatures. The drilling motor assembly includes upper and lower stabilizer subs to which are connected the drill string and drill bit respectively. The drill motor is disposed therebetween such that drilling fluid pumped through the drill string and upper sub will flow through the motor which in turn will drive the downhole tool. Drilling fluid passing through the motor will pass through a housing extension to the drill bit to transport cuttings back up the well. Extending between the stabilizer subs is a multiple wall housing which encloses the drill motor and housing extension. In a preferred embodiment, the inner wall is connected to the lower sub concentric relation to the motor. The outer wall is connected to the lower and upper subs in concentric relation to the inner wall thereby forming an inner and outer annulus. The outer wall is provided with a plurality of outlet ports while the housing extension includes a nozzle insert which allows drilling fluid to circulate through the inner and outer annulus to the outlet ports to continuously cool the motor. The nozzle and outlet ports are positioned such that drilling fluid from below the drilling motor is fully circulated through both annulus of the thermal shield.

Brief Description Of The Drawing

The present invention will be more fully understood by reference to the following detailed description of a preferred embodiment of the present invention when read in conjunction with the accompanying drawing, in which like reference characters refer to like parts throughout the views and in which.

Figure 1:
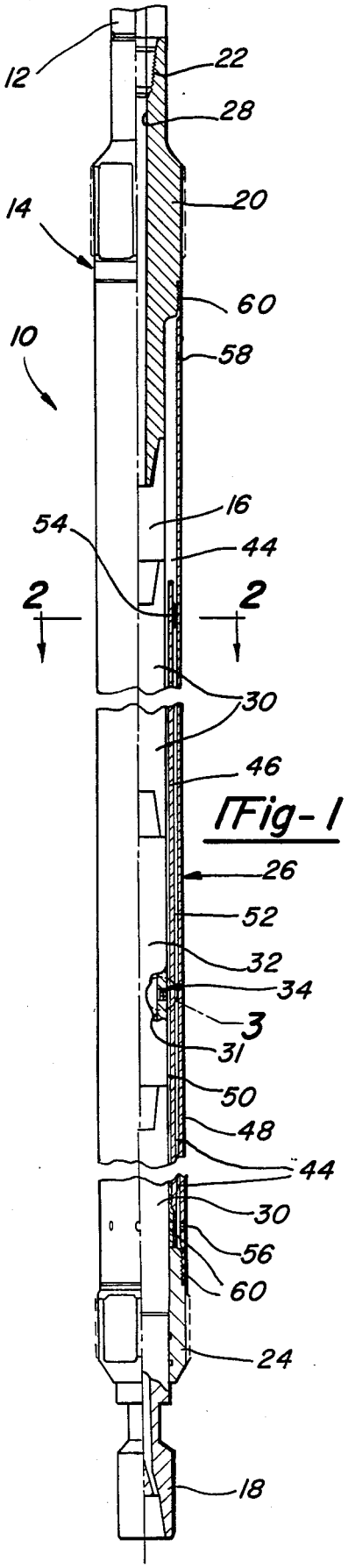
FIG. 1 is a perspective view partially in cross-section of a drilling assembly embodying the present invention.

Detailed Description Of A Preferred Embodiment Of The Present Invention

Referring now to the drawing, there is shown a drilling assembly 10 embodying the present invention and adapted for drilling well holes or descaling well tubing. The drilling assembly 10 is connected to a drill string 12 which is used to run the tool 10 into the hole and also through which drilling fluid is supplied to operate the drilling assembly 10. The drilling assembly 10 generally comprises a housing 14 which forms a thermal jacket or shroud for a drilling component such as a drilling motor 16 to maintain the operating temperature of the component within an acceptable range to prevent failure. The housing 14 is designed to insulate the component from extreme temperatures often found in wells, particularly geothermal wells, by circulating drilling fluid through the housing 14 as will be subsequently described. Although a preferred embodiment of the present invention will be described in conjunction with a drilling motor 16, it is to be understood that the present invention may be used to maintain the operating temperature of any number of drilling components. In the preferred embodiment, the drilling motor 16 is a positive displacement drilling motor having an elastomer stator bonded to the outer steel casing. The drilling motor 16 is used to operate a drilling tool 18 by circulating drilling fluid through the motor 16 in a well known manner. However, because the elastomer stator is bonded to the casing of the motor 16, the elastomer and adhesive can begin to break down at 200 to 250 degrees Fahrenheit. Typical temperatures in geothermal steam producing wells can reach 500 to 550 degrees Fahrenheit. Without a protective shroud, the drilling motor 16 would be inoperative.

Figure 2:
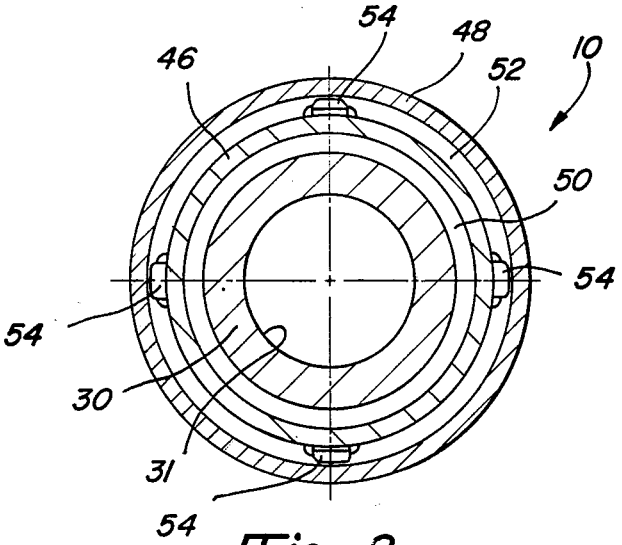
FIG. 2 is a lateral cross-sectional perspective of the drilling assembly taken along line 2—2 of FIG. 1.

Referring now to FIGS. 1 and 2, the housing 14 preferably includes an upper sub 20 connected by pin connector 22 to the drill string 12, a lower sub 24 through which the drill bit 18 is rotatably received, and a wall unit 26 extending between and connected to the end subs 20 and 24. The upper sub 20 includes an axial fluid passageway 28 which communicates with the fluid passageway of the drill string 12. Preferably connected to the upper sub 20 is the drilling motor 16 although any number of spacer subs 30 having axial fluid passageways 31 may be connected between the motor 16 and the upper sub 20. Additional spacer subs 30 may be axially connected downhole of the motor 16 to extend to the drilling tool 18. The string of subs includes at least one extension sub 32 positioned within the axial string. In a preferred embodiment, the extension sub 32 is connected downhole of the drilling motor 16 such that drilling fluid first flows through the housing of the motor 16. However, it is contemplated that the extension sub 32 may be mounted uphole of the motor 16. The drilling motor 16, spacer subs 30, extension sub 32 and the drilling tool 18 all include fluid passageways to permit the flow of drilling fluid therethrough as well as the passage of a drive shaft (not shown) drivably connecting the motor 16 and the drilling tool 18. As drilling fluid is circulated through the drilling motor 16, the drilling tool 18 will be rotated, by way of the drive shaft extending through the fixed subs 30 and 32, within the lower sub 24. Continuing flow of the drilling fluid will transport cuttings back up the hole.

Figure 3:
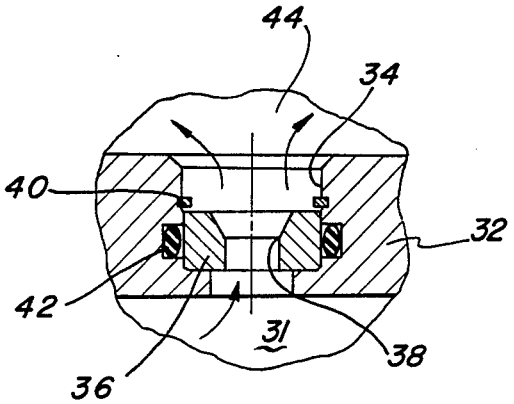
FIG. 3 is an enlarged cross-sectional perspective of the nozzle insert of the present invention.

As best shown in FIGS. 1 and 3, the extension sub 32 includes at least one inner fluid port 34 which provides fluid communication between the interior fluid passageway 31 of the sub 32 and the outer annulus of the sub 32 which formed by the wall unit 26 as will be subsequently described. Although a simple outlet port may be utilized, in a preferred embodiment a nozzle 36 is inserted within the port 34 to control the flow of drilling fluid therethrough. By altering the size and configuration of the opening 38 in the nozzle 36 the flow of drilling fluid into the wall unit 26 can be controlled to maintain proper fluid pressure within the inner passageway 31 of the central mandrel assembly as well as efficient fluid flow through the wall unit 26 to provide the required cooling of the housing 14. The configuration and size of the nozzle opening 38 can be varied according to the operating specifications of the drilling assembly 10 merely by replacing the nozzle 36. The nozzle 36 is positionally captured within the wall of the sub 32 by a removable snap ring 40. A high temperature 0-ring seal 42 is also provided to prevent fluid leakage past the nozzle 36.

Referring again to FIGS. 1 and 2, the wall unit 26 connected at both ends to the end subs 20 and 24 is disposed in concentric spaced-apart relation to the central mandrel assembly formed by the drilling motor 16 and subs 30, 32. The wall unit 26 includes at least two walls mounted in concentric spaced-apart relation to form a baffled fluid passage means 44 through which the cooling drilling fluid flows. Although any number of walls can be used to form a series of baffles, the present invention preferably includes an inner wall 46 and an outer wall 48. It has been found that two spaced-apart walls provide the necessary cooling effect while minimizing costs of manufacturing the housing assembly 14. In a preferred embodiment, the inner wall 46 is mounted in spaced-apart concentric relationship to the central mandrel assembly to form an inner annulus 50 of the fluid passage means 44. The inner wall 46 is preferably connected at its lower end to the lower end sub 24. The outer wall 48 is mounted at both ends to the upper end sub 20 and the lower end sub 24, respectively, in concentric spaced-apart relation to the inner wall 46 forming an outer annulus 52 of the fluid passage means 44. Since the upper end of the inner wall 46 is unattached drilling fluid is free to flow from the inner annulus 50 around the end of the inner wall 46 into the outer annulus 52. In an alternative embodiment, the inner wall 46 may be attached only at its upper end to the upper sub 20 such that fluid will flow past the lower unattached end of the inner wall 46. In either case, the unattached end of the inner wall 46 is preferably provided with a plurality of spacer elements 54 to maintain the spaced-apart relationship of the two walls 46 and 48.

Referring to FIG. 1 and a preferred embodiment of the present invention, the inner fluid port 34 is positioned well below the unattached end of the inner wall 46 such that drilling fluid will primarily flow upwardly through the inner annulus 50 of the fluid passage means 44. As the fluid flows around the end of the inner wall 46 into the outer annulus 52 the fluid will flow downwardly through the outer annulus 52. The outer wall 48 includes at least one outer fluid port 56 to provide fluid communication between the outer annulus 52 and the exterior of the drilling assembly 10. In a preferred embodiment, the outer wall 48 includes a plurality of circumferentially spaced ports 56 proximate the downhole end of the wall 48 to ensure continuous flow of fluid particularly to exhaust drilling fluid which has had its temperature increased as a result of the heat exchange with the exterior environment of the drilling assembly 10 and the drilling motor 16. Also formed in the outer wall 48 is a vent port 58 to vent any air or other gases from the fluid passage means 44. In a preferred embodiment, the vent port 58 is formed at the upper end of the outer wall 48 to vent gases which will rise through the fluid passage means 44.

Figure 4:
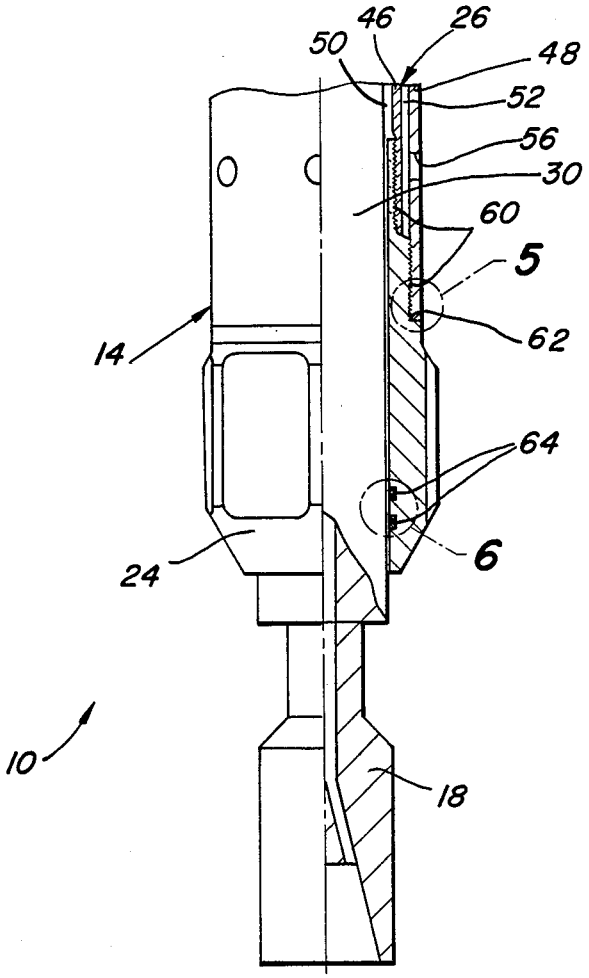
FIG. 4 is a perspective view of the lower end of the drilling the present invention.
Figure 5:
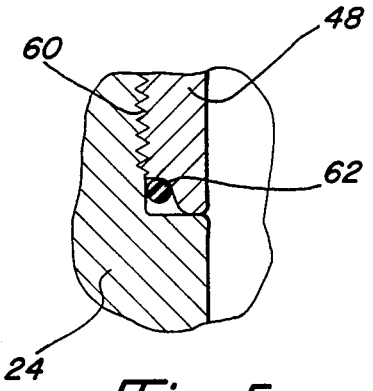
FIG. 5 is an enlarged cross-sectional perspective of portion 5 in FIG. 4.
Figure 6:
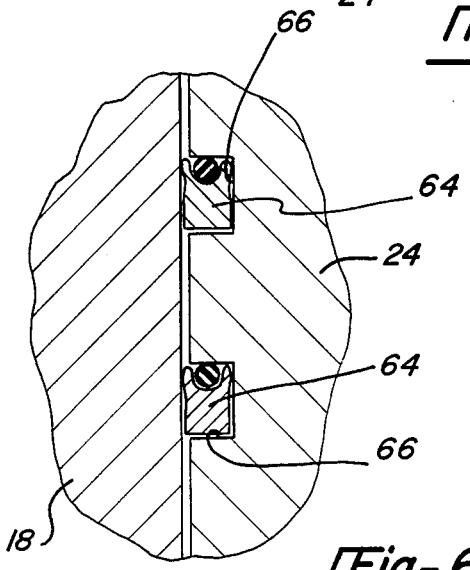
FIG. 6 is an enlarged cross-sectional perspective of portion 6 in FIG. 4.

Referring now to FIGS. 4 through 6, the inner wall 46 and the outer wall 48 are connected to the upper sub 20 and lower sub 24 by threads 60. In order to prevent leakage past the threads 60 an 0-ring seal 62 is interdisposed between the wall member and the end sub (FIG. 5). Furthermore, because the drilling tool 18 is rotatively received within the lower end sub 24, the sub 24 is provided with a pair of friction seals 64 (FIG. 6). In a preferred embodiment, the friction seals 64 are polypak high temperature seals received within annular grooves 66 formed in the lower sub 24. The seals 64 engage the rotating drilling tool 18 to support the tool within the sub 24.

The present invention provides a means of insulating the drilling motor 16 in high temperature operations by circulating drilling fluid through the housing 14 to provide a constant heat exchange thereby maintaining the operating temperature of the motor 16 within acceptable limits. Drilling fluid is circulated downhole through the drill string 12 and drilling motor 16 to operate the drilling tool 18. Particularly effective results have been attained using coiled tubing to run the tool 10 and deliver the drilling fluid. The coil of tubing has no intermediate joints and, thus, can be continuously supplied with fluid as the device is lowered into and retracted from the well. After passing through the drilling motor 16 into the extension sub 32, a portion of the drilling fluid will be diverted through the nozzle 36 into the fluid passage means 44. The drilling fluid will pass through the baffle formed by the inner annulus 50 and outer annulus 52 to cool the housing assembly 14 and maintain the temperature of the drilling motor 16. Thereafter, the drilling fluid is exhausted through the ports 56 into the borehole and will flow upwardly carrying cutting back up the hole. Thus, the present invention provides an efficient and simple means of cooling the housing assembly 14 using the drilling fluids used to operate the drilling assembly.

The foregoing detailed description has been given for clearness of understanding only and no unnecessary limitations should be understood therefrom as some modifications will be obvious to those skilled in the art without departing from the scope and spirit of the appended claims.

I claim:

1. A drilling assembly to be run into a well hole using a drill string, drilling fluid being supplied to said drilling assembly through the drill string, said drilling assembly comprising:

a housing assembly connected to said drill string; and a fluid operated drilling motor operatively connected to a drilling tool, said drilling motor having a motor housing disposed within said housing assembly;

said housing assembly including baffled fluid passage means surrounding said motor housing for circulating drilling fluid through said housing assembly to maintain the operating temperature of said drilling motor, said housing assembly including at least one inner fluid port to provide fluid communication between the interior of said housing assembly in fluid communication with the motor housing and one end of said fluid passage means and at least one outer fluid port to provide fluid communication between the other end of said fluid passage means and the exterior of said housing assembly, drilling fluid circulating through said at least one inner fluid port, through said circuitous fluid passage means and through said at least one outer fluid port to maintain the operating temperatures.

2. The drilling assembly as defined in claim 1 wherein said housing assembly includes upper and lower end subs and a tubular wall unit extending between and connected to said end subs, said fluid passage means formed in said tubular wall unit.

3. The drilling assembly as defined in claim 2 and further comprising an extension sub axially connected to said drilling motor, said extension sub including at least one inner fluid port to provide fluid communication between the interior of said extension sub and said fluid passage means, drilling fluid circulating through said at least one inner fluid port into said fluid passage means.

4. The drilling assembly as defined in claim 3 wherein said tubular wall unit includes at least two spaced apart concentric walls mounted in spaced apart concentric relation to said drilling motor and extension sub.

5. The drilling assembly as defined in claim 4 wherein said wall unit includes an outer tubular wall mounted at both ends to said end subs and an inner tubular wall connected at one end to one of said end subs, said outer wall mounted in concentric spaced apart relation to said inner wall to form an outer annulus and said inner wall mounted in concentric spaced apart relation to said drilling motor and extension sub to form an inner annulus, said inner and outer annulus forming said fluid passage means of said housing assembly.

6. The drilling assembly as defined in claim 5 wherein said at least one outer fluid port is formed in said outer wall to provide fluid communication between said fluid passage means and the exterior of said housing assembly.

7. The drilling assembly as defined in claim 3 wherein said extension sub is axially mounted downhole of said drilling motor such that drilling fluid first flows through said drilling motor prior to flowing into said fluid passage means

8. The drilling assembly as defined in claim 7 wherein said at least one inner fluid port includes a replaceable nozzle positionally captured within the wall of said extension sub, said nozzle restricting the flow of drilling fluid into said fluid passage means.

9. The drilling assembly defined in claim 5 wherein the unattached end of said inner wall includes a plurality of spacers to maintain the spaced apart relationship with said outer wall.

10. The drilling assembly as defined in claim 9 wherein said outer wall includes at least one vent port formed proximate said upper end sub, said at least one outer fluid port formed proximate said lower end sub.

11. The drilling assembly as defined in claim 10 wherein said inner wall is secured to said lower end sub such that drilling fluid will flow through said at least one inner port formed in said extension sub into said inner annulus formed between said extension sub and said inner wall, upwardly past the unattached end of said inner wall into said outer annulus formed between said inner wall and outer wall, and downwardly to said at least one outer fluid port in said outer wall for discharge to the exterior of said drilling assembly.

12. The drilling assembly as defined in claim 11 wherein said lower sub includes first seal means to provide sealing engagement between said drilling tool and said housing assembly, said drilling tool rotatably received within said lower end sub of said housing assembly.

13. The drilling assembly as defined in claim 12 wherein said outer wall and said inner wall are threadably connected to said end subs, said housing assembly including second seal means between said wall unit and said end subs.

14. A drilling assembly to be run into a well hole using a drill string, a drilling fluid being supplied to said drilling assembly through the drill string, said drilling assembly comprising:

a housing assembly connected to said drill string, said housing assembly including end subs and a wall unit extending between said end subs, said wall unit including circuitous fluid passage means for circulation of drilling fluid therethrough;

a fluid operated drilling motor operatively connected to a drilling tool, said drilling motor having a motor housing disposed within said housing assembly;

an extension sub axially connected to and in fluid communication with said drilling motor housing, said extension sub including at least one inner fluid port to provide fluid communication between the interior of said extension sub and one end of said fluid passage means; and at least one outer fluid port formed in an exterior wall of said wall unit to provide fluid communication between the other end of said fluid passage means and the exterior of said drilling assembly, drilling fluid circulating from the interior of said extension sub through said circuitous fluid passage means of said wall unit of said housing assembly to the exterior of said housing assembly through said at least one outer fluid port to maintain the operating temperature of said drilling motor.

15. The drilling assembly as defined in claim 14 wherein said wall unit includes an outer tubular wall threadably connected at both ends to said end subs and an inner tubular wall threadably connected at one end to one of said end subs, said outer wall mounted in concentric spaced apart relation to said inner wall to form an outer annulus and said inner wall mounted in concentric spaced apart relation to said drilling motor and extension sub to form an inner annulus, said inner and outer annulus fluidly communicating around the unattached end of said inner wall to form said fluid passage means.

16. The drilling assembly as defined in claim 15 wherein said at least one outer fluid port is formed in said outer wall proximate said end sub to which said inner wall is connected.

17. The drilling assembly as defined in claim 14 wherein said at least one inner fluid port includes a replaceable nozzle positionally captured within the wall of said extension sub, said nozzle restricting the flow of drilling, fluid into said fluid passage means.

18. The drilling assembly as defined in claim 15 wherein the unattached end of said inner wall includes a plurality of circumferentially-spaced spacers to maintain the spaced apart relationship of said inner wall with said outer wall.

19. The drilling assembly as defined in claim 16 wherein said outer wall includes at least one vent port, said at least one vent port at the opposite end of said outer wall from said at least one outer fluid port.

20. An insulating housing for a fluid operated downhole drilling tool having a motor housing to insulate the tool from high temperature environments of a well hole, said housing comprising:

upper and lower end subs; and a tubular wall unit extending between and connected to said end subs, said wall unit having at least two spaced apart concentric walls mounted in spaced apart relation to the drilling tool motor housing including an outer tubular wall connected at both ends to said end subs and at least one inner wall connected at one end to one of said end subs to form a baffled fluid passage means through which drilling fluid from said drilling tool motor housing is circulated, said motor housing including fluid inlet means for circulation of said drilling fluid into one end of said baffled fluid passage means and said outer wall including at least one outer fluid port for discharge of said drilling fluid from the other end of said baffled fluid passage means to the exterior of the wall unit.

21. The housing as defined in claim 20 wherein the drilling tool is axially connected to a mandrel extension sub disposed within said housing.

22. The housing as defined in claim 21 wherein said fluid inlet means includes at least one inner fluid port having a replaceable nozzle inserted into said port, said nozzle restricting fluid flow into said fluid passage means.

23. The housing as defined in claim 22 wherein said unattached end of said at least one inner wall includes a plurality of circumferentially spaced spacer members.

24. A drilling assembly to be run in a well hole using a drill string, a drilling fluid being supplied to said drilling assembly through the drill string, said drilling assembly comprising:

a housing assembly connected to said drill string, said housing assembly including end subs and a wall unit extending between said end subs, said wall unit including fluid passage means for circulation of drilling fluid therethrough, said wall unit including an outer tubular wall connected at both ends to said end subs and an inner tubular wall connected at one end to one of said end subs, said inner and outer walls mounted in concentric spaced apart relation to form an inner and an outer annulus, said inner and outer annuluses fluidly communicating around the unattached end of said inner wall to form said fluid passage means;

a fluid operated drilling motor operatively connected to a drilling tool, said drilling motor having a motor housing disposed within said housing assembly;

an extension sub axially connected to said drilling motor housing, said extension sub including at least one inner fluid port to provide fluid communication between the interior of said extension sub and said fluid passage means; and at least one outer fluid port formed in said outer wall of said wall unit proximate said end sub to which said inner wall is attached to provide fluid communication between said fluid passage means and the exterior of said drilling assembly, drilling fluid circulating from the interior of said extension sub through said fluid passage means to maintain the operating temperature of said drilling motor.

25. The drilling assembly as defined in claim 24 wherein said at least one inner fluid port includes a replaceable nozzle positionally captured within the wall of said extension sub, said nozzle restricting the flow of drilling fluid into said fluid passage means.

26. The drilling assembly as defined in claim 24 wherein the unattached end of said inner wall includes a plurality of circumferentially-spaced spacers to maintain the spaced apart relationship of said inner wall with said outer wall.

27. The drilling assembly as defined in claim 24 wherein said outer wall includes at least one vent port, said at least one vent port at the opposite end of said outer wall from at least one outer fluid port.

28. A drilling assembly to be run into a well hole using a drill string, drilling fluid being supplied to said drilling assembly through the drill string, said drilling assembly comprising:

a housing assembly connected to said drill string, said housing assembly including upper and lower end subs and a tubular wall unit extending between and connected to said end subs, said wall unit having an outer tubular wall mounted at both ends to said end subs and an inner tubular wall connected at one end to one of said end subs, said inner and outer walls mounted in concentric spaced apart relation; and a fluid operated drilling motor operatively connected to a drilling tool, said drilling motor having a motor housing disposed within said housing assembly and connected to an extension sub;

said housing assembly including fluid passage means formed by said inner and outer walls for circulating drilling fluid through said housing assembly to maintain the operating temperature of said drilling motor, said extension sub including at least one inner fluid port to provide fluid communication from the drill string to one end of said fluid passage means and said outer wall including at least one outer fluid port to provide fluid communication from the other end of said fluid passage means to the exterior of said housing assembly, drilling fluid circulating through said at least one inner fluid port into said fluid passage means and through said at least one outer fluid port.

29. The drilling assembly as defined in claim 28 wherein said at least one inner fluid port includes a replaceable nozzle positionally captured within the wall of said extension sub, said nozzle restricting the flow of drilling fluid into said fluid passage means.

30. The drilling assembly as defined in claim 28 wherein the unattached end of said inner wall includes a plurality of spacers to maintain the spaced apart relationship of said outer wall.

31. The drilling assembly as defined in claim 28 wherein said outer wall includes at least one vent port formed proximate said upper end sub, said at least one outer fluid port formed proximate said lower end sub.

* * * * *